United States Patent [19]

O'Connor

[11] 4,157,476

[45] Jun. 5, 1979

[54] DENTAL X-RAY TUBE HEAD

[75] Inventor: Richard A. O'Connor, New Berlin, Wis.

[73] Assignee: General Electric Company, Schenectady, N.Y.

[21] Appl. No.: 874,952

[22] Filed: Feb. 3, 1978

[51] Int. Cl.[2] ..... H01J 35/16; H05G 3/00

[52] U.S. Cl. ..... 250/520; 250/515

[58] Field of Search ..... 250/520, 519, 517, 515, 250/505

[56] References Cited

U.S. PATENT DOCUMENTS

| | | | |
|---|---|---|---|
| 1,227,884 | 5/1917 | Caldwell | 250/520 |
| 3,549,478 | 12/1970 | Gillery et al. | 250/515 |
| 3,858,050 | 12/1974 | Carlson | 250/515 |

FOREIGN PATENT DOCUMENTS

| | | | |
|---|---|---|---|
| 280636 | 11/1927 | United Kingdom | 250/520 |

*Primary Examiner*—Bruce C. Anderson

*Attorney, Agent, or Firm*—Ralph G. Hohenfeldt

[57] ABSTRACT

In a dental x-ray tube head, the x-ray tube is in a casing that supports the tube and shields against stray radiation being projected to the environment through the housing of the tube head. The casing has an aperture for exit of the primary x-ray beam which is directed toward the examination subject. A hollow conical casting extension has its open-ended base intergral with the lower wall of the housing and its open apex end proximate to the aperture in the shield casing. A hollow conical liner comprised of x-ray absorbent material is fastened in the conical casting extension. The shield casing and liner are comprised of resin which is impregnated with barium sulphate.

1 Claim, 5 Drawing Figures

DENTAL X-RAY TUBE HEAD

BACKGROUND OF THE INVENTION

This invention pertains to improvements in apparatus for performing dental x-ray examinations. The invention features a better way to shield a dental x-ray tube head for preventing emanation of unwanted stray radiation.

Dental x-ray apparatus customarily has the x-ray tube enclosed in an oil filled housing called a tube head. The lower wall of the tube head has an opening through which the primary x-ray beam is projected from the x-ray tube target toward the examination subject. A tubular member, called a cone, is coupled to the tube head axially of the opening to assist in aiming the x-ray beam at the proper zone on the subject's face. Heretofore, the x-ray tube head or housing has been lined with an x-ray shield such as sheet lead to prevent the stray radiation, that is, radiation other than that in the primary beam, from emanating in all directions through the walls of the housing. Most of the sheet lead is usually disposed on the inside wall of the housing so that it encloses a volume which is substantially the same as the volume of the housing. One reason for arranging the lead sheet in this way is to avoid having it be too close to the x-ray tube and other components in the tube head which have high voltage applied to them.

The use of a large amount of lead for shielding results in a tube head that has undesirably great weight and size. A consequence is that the pantograph type of tube head support arm, which is usually used to support the tube head for movement with all degrees of freedom, must be designed for handling the unduly high weight. It is more difficult to support a heavy tube head in such manner that it will remain in equilibrium when positioned near the patient than it is to support a lighter tube head. Moreover, when pieces of lead sheet are used for shielding, there is a greater chance for radiation to leak through a joint.

A primary object of the present invention is to overcome the above noted disadvantages and other disadvantages by providing a new method and structure for shielding a dental x-ray tube head.

A more specific object of the invention is to obviate the use of sheet lead for shielding a dental x-ray tube head.

Yet another object is to provide an x-ray tube shield which serves the dual purposes of supporting the tube and shielding it against radiating in undesired directions.

Still another object is to provide a shield that extends through the housing between the shield that surrounds the x-ray tube and the x-ray head cone and which is arranged in such manner that the external cone can be made much shorter than in prior designs.

A more specific object is to provide shielding components in an x-ray tube head which are comprised of dielectric resin impregnated with barium sulphate which can be molded to form shielding components in the most advantageous configurations for reducing the volume that is required for shielding. An adjunct of this object is to obtain a tube head that has reduced size and weight.

In accordance with the invention, in a dental x-ray tube head comprising a housing having an x-ray tube mounted in it, there are improved shielding means for preventing stray radiation from emanating outside of the path of the primary x-ray beam, the shielding means including a hollow element encasing the x-ray tube and having an aperture through which the primary beam projects, said element being comprised of a mixture of resin and barium sulphate. A further improvement results from use of a conical element for defining the beam path from the x-ray tube to outside of the housing wherein the conical element has shielding liner comprised of resin impregnated with barium sulphate.

How the foregoing and other more specific objects of the invention are achieved will appear in the more detailed description of a preferred embodiment of the invention which will now be set forth in reference to the drawings.

DESCRIPTION OF A PREFERRED EMBODIMENT

Figure 1:
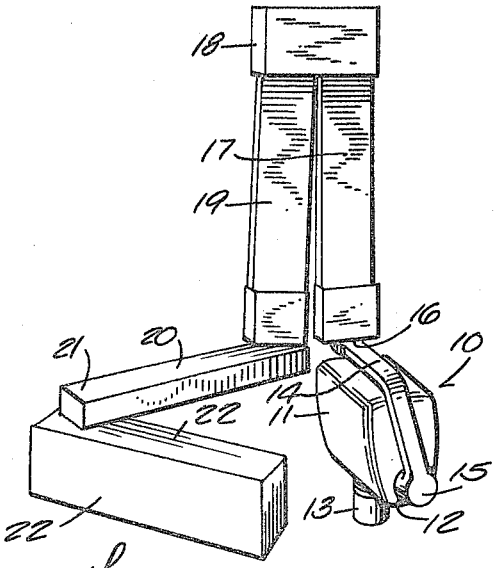
FIG. 1 is a perspective view of a dental x-ray tube head and its supporting arm mechanism.

Dental x-ray apparatus which includes the new shielding construction is depicted in FIG. 1. The dental x-ray tube head is generally designated by the reference numeral 10. It comprises a housing 11 having a bottom wall 12 to which a tubular assembly 13 is attached. This assembly is otherwise known as a cone. The tube head is carried by a link 14 which allows the head to turn about a horizontal axis extending through the point where reference numeral 15 is applied. Link 14 can also turn about a vertical axis in the vicinity of where reference numeral 16 is applied. Link 14 is pivotal on a first pantograph arm which is pivotally connected at one end 18 to a second pantograph arm 19. The latter is mounted for rotation about a vertical axis on a horizontally swingable arm 20 which turns about a vertical axis where the reference numeral 21 is applied. Swinging arm 20 is mounted on the x-ray tube controller 22 which is symbolized by a prism shaped box. This box may be mounted on a wall in the examination room in proximity with the chair on which the examination subject rests as is self-evident. It will be apparent that the support arm assembly for the tube head which has just been described will enable the tube head 10 to be advanced and retracted and angulated as desired relative to the examination subject. The functional features of the tube support are essentially conventional.

Figure 2:
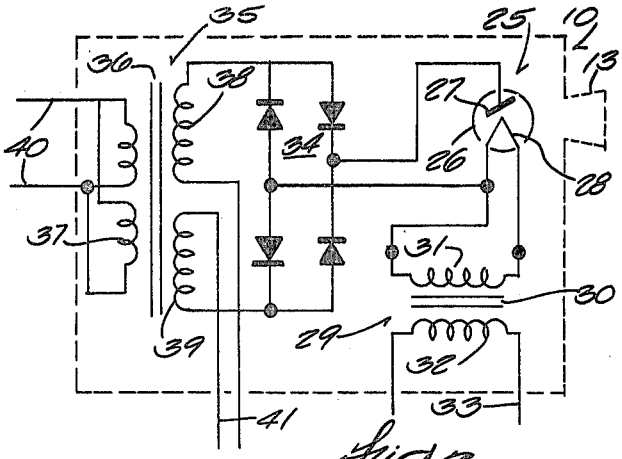
FIG. 2 is a schematic diagram of the electric circuitry and electric components in a typical x-ray tube head.

In FIG. 2, typical electrical components used in x-ray tube head 10 include an x-ray tube which is generally designated by the reference numeral 25 and comprises a glass envelope 26, an anode or target 27 and an electron emitting filament 28. The filament is heated with current delivered from a transformer 29 which has a core 30, a secondary winding 31 and a primary winding 32. The primary winding is fed from a pair of leads 33 that extend back through the pantograph or support arm assembly to the control box 22. High voltage is applied between anode 27 and electron emitting filament 28 from a full-wave rectifier bridge 34. The alternating current input to the rectifier bridge is from a high voltage step-up transformer 35 comprising an iron core 36, paralleled primary windings 37 and split secondary windings 38 and 39. The primary windings are supplied through a pair of leads 40 which go back to the control box through the pantograph arm assembly. A pair of leads 41 extending from the inside legs of the secondary windings extend back to the control box in a similar manner and are used for sensing the current which flows between the cathode filament 28 and anode 27 of the x-ray tube. The cone 13, which is used for aiming the x-ray tube head toward the proper place on the examination subject's face, is symbolized by dashed lines in FIG. 2.

Figure 3:
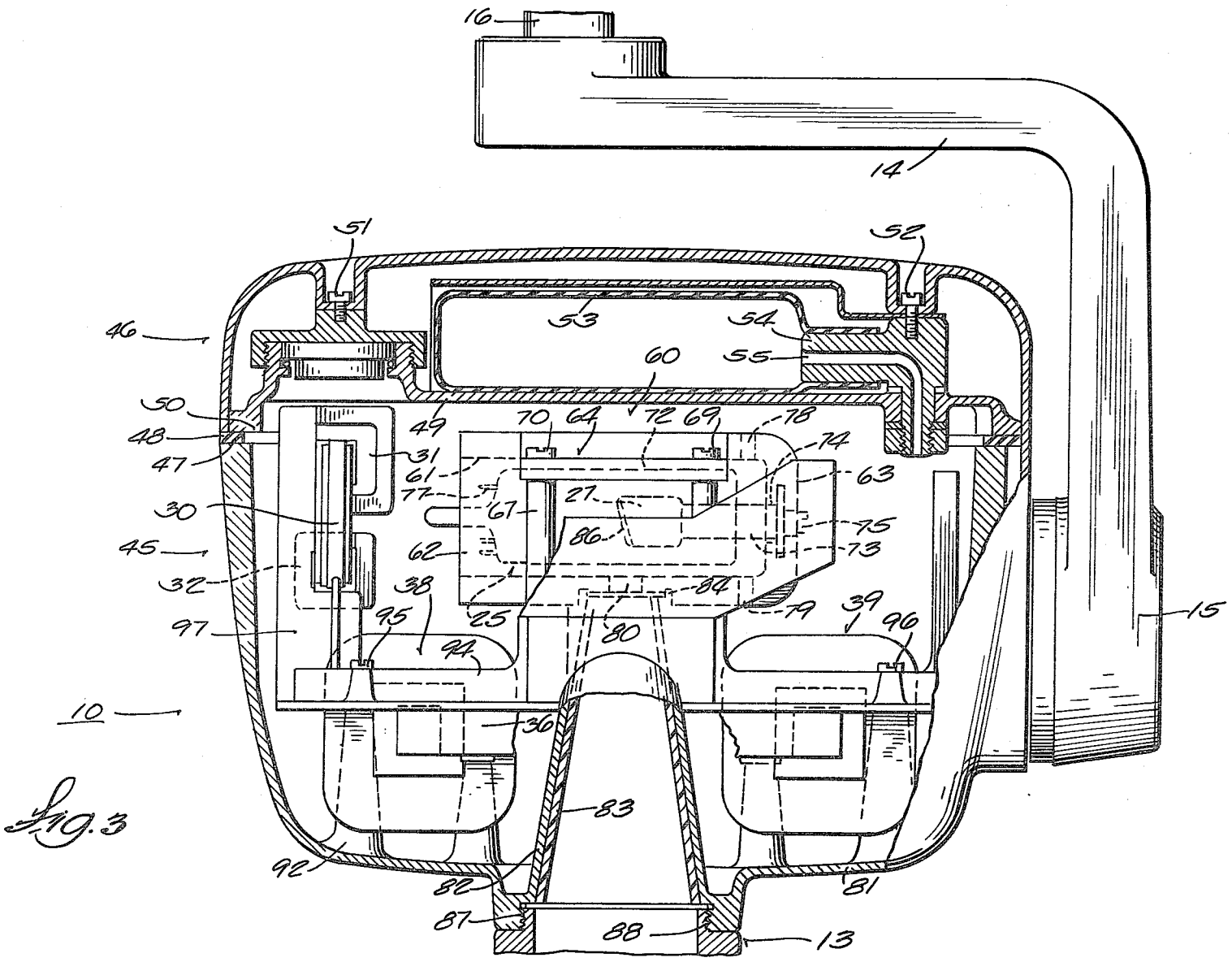
FIG. 3 is a vertical longitudinal section of the x-ray tube head.

A vertical section of the actual x-ray tube head including the new shielding means appears in FIG. 3. The tube head comprises a housing having a deep bottom part 45 and a cover 46. Bottom part 45 is essentially a deep bowl having sufficient internal volume to accommodate the various electric components which were mentioned in connection with FIG. 2. The bottom part of the housing has an upper rim 47 on which there is a sealing gasket 48. A horizontal wall 49 having a flat rim 50 around its perimeter is pressed against the gasket 48 by means of bolts, not shown, which screw into suitable anchors, that are cast with lower housing part 45. Gasket 48 and rim 50 of wall 49 cooperate to seal the insulating oil in lower housing part 45. Cover 46 is secured to wall 49 by means of screws such as those which are marked 51 and 52.

A flexible container 53 is provided for accommodating expansion and contraction of the insulating oil which occupies lower housing part 45. Flexible container 53 is connected to a fitting 54 which has a passageway 55 for allowing the exchange of insulating oil between lower housing part 45 and the expansion container.

Cover 46 and lower housing part 45 are preferably made of cast aluminum for the sake of minimizing the weight of the x-ray tube head 10. As is well known, however, aluminum like other lightweight low atomic number elements has very poor x-ray attenuating properties so that additional x-ray shielding must be provided to prohibit stray x-radiation from emanating out of the tube head.

Figure 5:
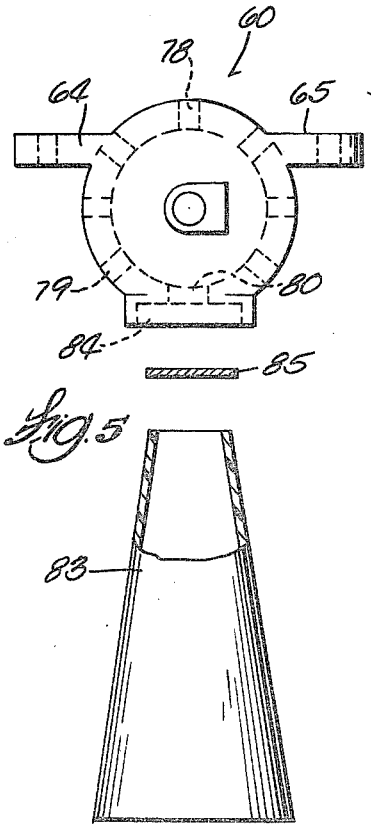
FIG. 5 is an exploded view of the x-ray tube shield and beam path shield isolated from the tube head.
Figure 4:
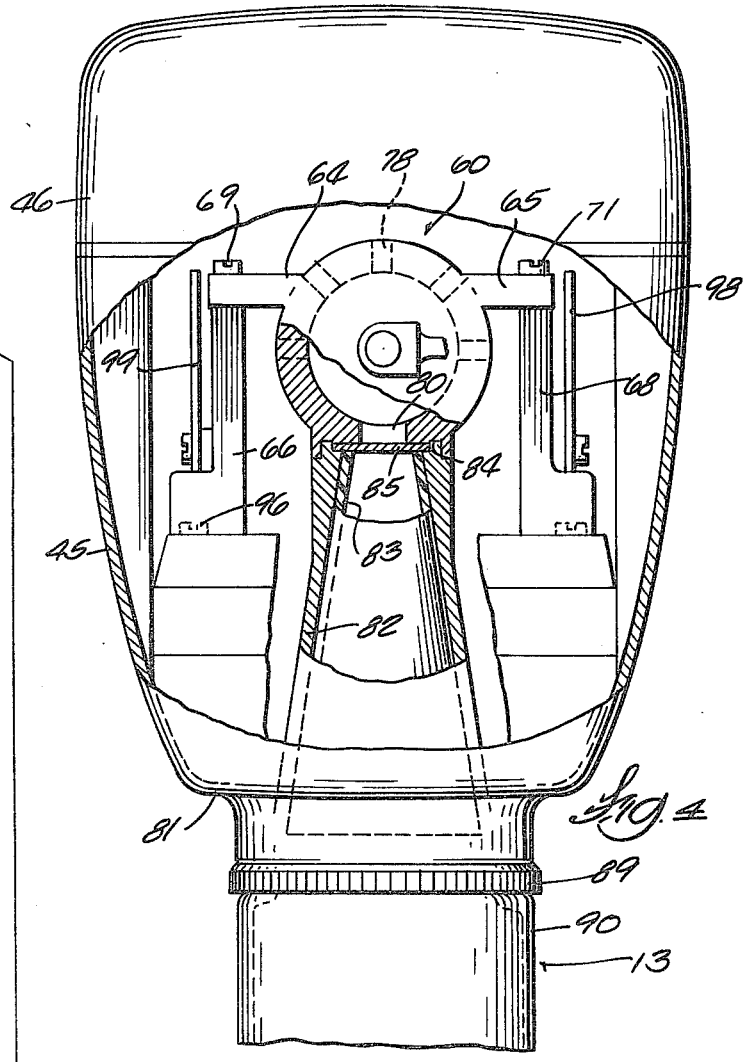
FIG. 4 is an end elevation, taken from the right end of the tube head shown in FIG. 3, having some parts broken away and other parts omitted to show the shielding components.

FIGS. 3 and 4 illustrate how shielding of the x-ray tube is accomplished, using a casing which is generally designated by the reference number 60. This casing is generally cylindrical and it has an internal bore 61. The casing has an open end 62 and a wall 63 at the opposite end which closes the cylinder at that end. Casing 60 has laterally extending flanges 64 and 65 which can be seen clearly in FIGS. 4 and 5. The flanges are secured to upstanding posts such as those marked 66 and 67 on one side and the one marked 68 on the other side as seen in FIGS. 3 and 4. Flanges 64 and 65 are fastened to the posts with machine screws such as those marked 69, 70 and 71.

The glass envelope 26 of the x-ray tube 25 appears in outline and in dashed lines within the cylindrical tube casing or shield 60 in FIG. 3. The anode 27 of the x-ray tube 25 is mounted on a metal stem 73 which extends sealingly out of the end of the glass x-ray tube envelope 26 and passes into a bore 74 in the end wall 63 of the cylindrical shield or casing 60. The high voltage lead wire for the x-ray tube anode may be connected to it by means of screw 75. The wire is omitted for the sake of clarity. It will be evident that the x-ray tube 25 is supported in cantilever fashion from shield 60 by means of stem 73. The end of the x-ray tube which is adjacent open end 62 of shield casing 60 has several connector pins 77 extending from it. Three wires, not shown in FIG. 3, are soldered to these pins for making connections to elements in the x-ray tube 25 as will be evident from inspection of the electrical diagram in FIG. 2.

There is an annular free space 72 around x-ray tube envelope 26 to enable circulation of insulating fluid over the x-ray tube envelope to cool it. The wall of the cylindrical shield or casing 60 has several radially extending and circumferentially spaced apart holes such as those marked 78 and 79 for allowing circulation of the insulating fluid through the interior of x-ray tube shield casing 60.

X-rays are produced at a focal spot 86 on the angulated front end of x-ray target or anode 27. Shield casing 60 has an aperture 80 in its wall for permitting the primary x-ray beam to pass from the target toward the exterior of the tube head housing.

The x-ray tube shield casing 60 is, according to the invention, composed of resin impregnated with barium sulphate. Barium, being a high atomic number element, is an effective x-radiation absorber. The resin should be one that has good dielectric properties sufficient to withstand the usual fifty or more kilovolts applied to the x-ray tube with a substantial safety factor. Polyester and epoxy resins are typical of those which may be used. The resin should be free of contaminants such as conductive carbon so its dielectric strength is not impaired. A molding compound for the shield casing 60, which has been found especially suitable, is an alkyd compound containing polyester resin and finely powdered barium sulphate impregnant or filler which is maintained at 68.5% minimum by weight. A specially formulated molding compound of this type which has been used is known as Plenco 1529. Phenolic resin impregnated with lead is excluded from the class of high dielectric strength molding compounds that are permissible. Lead is toxic and is a health hazard to persons involved in making the molding compound and in molding with it as well.

The path of the primary x-ray beam which projects from target 27 through aperture 80 in the casing shield 60 is also shielded against stray radiation without using lead. For this reason, the bottom wall 81 of lower housing part 45 has a basically tubular or hollow and interiorly conical metallic structural part 82 cast integrally with it. Conical part 82 is open at its base and apex ends. As can be seen in FIG. 3, interiorly conical structural part 82 converges toward x-ray exit aperture 80 in the x-ray tube shield 60. A counterbore 84 in the upper end of metallic conical part 82 is used to accommodate a thin wafer 85, constituting a soft x-ray filter and insulating fluid seal as will be described further below. A complementary conical liner 83 is cemented to the inside of conical part 82. The liner 83 serves as an x-ray shield and as a primary x-ray beam limiting device. Liner 83 is made of the same material as x-ray tube casing shield 60 which was just described. The apex end of conical liner 83 terminates near the previously mentioned shallow counterbore 84 which surrounds aperture 80 in shield casing 60. The filter wafer is marked 85 in the FIG. 5 exploded view where it is shown in section. The wafer may comprise any metal that is suitable for absorbing low energy x-radiation and transmitting the high energy radiation in the primary beam. The filter wafer 85 is cemented in counterbore 84. The arrangement is such that the x-ray shielding effect is continuous from within the oil filled casing 45, past the filter/oil seal and into the beam limiting liner 83. Moreover, there is a synergistic cooperation between the parts in that the metallic conical part 82 in which the beam limiting liner 83 is cemented is integral with housing 45 and the filter serves as an oil seal, thus maximizing the structural and x-ray impermeability of the tube head with a minimum number of parts.

Around the base of conical casting part 82 in FIG. 3, there is an internal thread 87 which is for receiving the externally threaded end 88 of the x-ray cone 13. As can be seen in FIG. 4, the external x-ray cone 13 has a lock nut 89 for holding it. Cone 13 comprises a tubular lead-lined plastic part 90 whose end, broken away, may be disposed against the patient's face or head prior to making a radiographic exposure.

Referring again to FIG. 3, one may see that the coils or windings 38 and 39 for the high voltage transformer are mounted on core 36 and are disposed on opposite sides of conical casting extension or structural part 82. Core 36 is wound of transformer steel strip and, if it were viewed from the top, it would be evident that a rectangular opening is formed which allows the core and coils of the high voltage transformer to be disposed around conical extension 82 and its internal complementary x-ray shielding liner 83. This construction enables the x-ray tube 25 and its focal spot 86 to be set back a substantial distance from the bottom 81 of the housing 45. Hence, a shorter external cone 90 is required to achieve a long focal spot-to-film distance than would otherwise be required if the x-ray tube were closer to the bottom 81 of the housing.

In FIG. 3, it is evident that several posts such as those marked 92 and 93 are cast integrally from the bottom wall 81 of lower housing part 45. A frame 94 rests on these posts and is secured to the posts with screws such as those marked 95 and 96. The frame supports the high voltage transformer core 36. An upstanding member 97 is mounted on the frame for supporting the core 30 and the coils 31 and 32 constituting the primary and secondary windings of the filament transformer 29. Boards made of insulating material and marked 98 and 99 in FIG. 4 are provided for supporting the diodes for the full wave rectifier bridge 34 which is shown schematically in FIG. 2. The connecting wires within the tube head casing have been omitted from FIGS. 3 and 4 for the sake of clarity since they are not directly involved in the new method of shielding the x-ray tube head and the primary x-ray beam path. The long conductors which lead back from the tube head to the control box 22 through the pantograph or tube support arm assembly are also omitted for the sake of brevity and clarity.

Although the invention has been described in considerable detail to elucidate the best mode of practicing it and to enable those skilled in the art to reproduce it, such description is intended to be illustrative rather than limiting, for the invention may be variously embodied and is to be limited only by interpretation of the claims which follow.

I claim:

1. A dental x-ray tube head comprising:

a housing for containing dielectric coolant fluid and being defined by a plurality of walls, an x-ray tube in said housing for projecting a primary x-ray beam in a predetermined path toward an examination subject, a hollow x-ray shielding casing element located in said housing for being immersed in coolant fluid and encasing said x-ray tube and having an aperture through which said primary beam projects, said aperture being surrounded by a recess and being spaced by a substantial distance from one of the walls of said housing, a tubular member formed integrally with said one wall of said housing and extending from said one wall toward said aperture, said member surrounding the path in which said primary beam is projected and having an end terminating in proximity with said shielding casing in alignment with said aperture in said casing, an x-ray beam limiting and shielding liner disposed in said tubular member, said liner having a hollow conical interior and base and apex ends in which there are axial openings, respectively, the apex end extending into said recess around said aperture and being in fluid and radiation impermeable sealing relationship with said shielding casing and said opening in the apex end being aligned with said aperture, an x-ray filter wafer extending across the apex end opening and sealed to the apex end of said liner, said shielding casing element and said liner being composed of a solidified mixture of resin and barium sulphate.

* * * * *